United States Patent [19]

Hale

[11] Patent Number: 4,474,328

[45] Date of Patent: Oct. 2, 1984

[54] VARIABLE LIFT SPRINKLER UNIT

[76] Inventor: Virginia Hale, 340 West "K" St., Brawley, Calif. 92227

[21] Appl. No.: 426,623

[22] Filed: Sep. 29, 1982

[51] Int. Cl.[3] ..... B05B 3/02

[52] U.S. Cl. ..... 239/227; 239/DIG. 1

[58] Field of Search ..... 239/227, 237, 240, 244, 239/252, DIG. 1

[56] References Cited

U.S. PATENT DOCUMENTS

| | | | |
|---|---|---|---|
| 1,796,942 | 3/1931 | Pottenger | 239/236 |
| 1,938,838 | 12/1933 | Jacobson | 239/236 |
| 1,962,308 | 6/1934 | Jacobson | 239/236 |
| 2,557,206 | 6/1951 | Spender | 239/252 |
| 2,586,517 | 2/1952 | Coles | 239/244 |
| 2,782,071 | 2/1957 | Chavez | 239/230 |
| 2,865,672 | 12/1958 | Guinard | 239/252 |
| 3,070,315 | 12/1962 | Landry | 239/232 |
| 3,275,241 | 9/1966 | Saad | 239/252 |
| 3,428,256 | 2/1969 | Painter | 239/240 X |
| 3,458,136 | 7/1969 | Belaieff | 239/227 |
| 3,878,990 | 4/1975 | Geraudie | 239/236 |
| 4,154,404 | 5/1979 | Clawson | 239/563 |
| 4,266,730 | 5/1981 | Grohe | 239/587 |
| 4,277,029 | 7/1981 | Rabitsch | 239/232 |

FOREIGN PATENT DOCUMENTS

| | | | |
|---|---|---|---|
| 29073 | 12/1965 | Japan | 239/227 |

*Primary Examiner*—John J. Love
*Assistant Examiner*—James R. Moon, Jr.
*Attorney, Agent, or Firm*—Brown & Martin

[57] ABSTRACT

A variable lift sprinkler unit includes a support member for attachment to a stationary water supply line with a first rotatable member mounted on the support member for rotation about a generally vertical axis and a second rotatable member rotatably mounted on the first rotatable member for rotation about an axis at an angle to the first member with the sprinkler nozzle carried by the second member such that the angle of the nozzle relative to the horizon continues to change during rotation of the unit with means for rotating the second rotatable member with respect to the first rotatable member during rotation thereof relative to the support member.

12 Claims, 8 Drawing Figures

VARIABLE LIFT SPRINKLER UNIT

BACKGROUND OF THE INVENTION

The present invention relates to sprinkler units and pertains particularly to rotating sprinkler heads.

Rotatable sprinkler units or sprinkler heads are extensively used for irrigation purposes because they are capable of covering large areas. This large area of coverage by rotatable sprinkler heads reduces the amount of conduit that is necessary for supplying the water to the area to be irrigated.

One of the major drawbacks to rotary sprinkler heads is the nonuniformity of coverage achieved by the sprinkler head. Any interference with the primary stream of water from the sprinkler head tends to reduce the area of coverage of the sprinkler head. Impact type impulse sprinkler heads are one of the most widely used rotary sprinkler heads today. However, these sprinkler heads, although adjustable to improve coverage, also suffers from the problem of lack of adjustability to provide fairly uniform coverage.

When a sprinkler head is adjusted to provide a very large area of coverage, it tends to supply a greater amount of water to the outer perimeter to the area covered than in the inner area. The angle of the nozzle with the horizon often controls the range (i.e. outer diameter) of coverage. Thus, the higher the angle, within limits, the larger the diameter of the area covered, whereas the lower the angle toward or even below the horizontal, the smaller the area covered.

It is therefore desirable to provide means for providing regular uniform adjustment of the sprinkler unit lift to obtain maximum uniformity of coverage of the area.

SUMMARY AND OBJECT OF THE INVENTION

It is therefore the primary object of the present invention to provide an improved rotary sprinkler unit.

In accordance with the primary aspect of the present invention, a sprinkler unit includes a base member for coupling to a water supply line with a first rotatable member rotatably mounted on the base member and a second rotatable member rotatably mounted on the first rotatable member with means for rotating the first and second rotatable members such that the nozzle carried by the second rotatable member is constantly changing in its angle of lift during each revolution of the sprinkler unit for constantly varying the area of coverage during each revolution of the sprinkler unit.

BRIEF DESCRIPTION OF THE DRAWINGS

The above and other objects and advantages of the present invention will become apparent from the following description when read in conjunction with the drawings wherein.

DETAILED DESCRIPTION OF PREFERRED EMBODIMENTS

Figure 1:
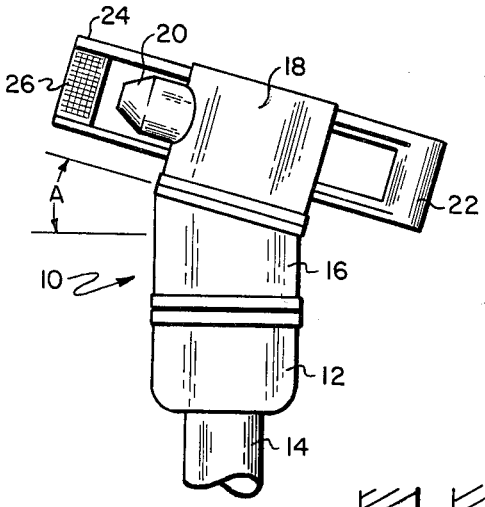
FIG. 1 is a side elevation view of a preferred embodiment of the invention.

Turning to the drawings, particularly FIG. 1, there is illustrated a variable lift sprinkler head in accordance with the present invention designated generally by the numeral 10. The sprinkler unit comprises a support or base member 12 having a generally cylindrical configuration for mounting on the end of a water supply line 14. A first rotatable member 16 is rotatably mounted on the fixed housing member 12 for rotating about a generally vertical axis coaxial with the base housing member 12. The first rotatable member 16 has a generally wedged-shaped configuration (transverse to its rotary axis) and supports a second rotatable member 18 which is rotatably mounted on the first rotatably member 16 for rotation about an axis at an angle "A" to the axis of rotation of the member 16. This angle, determines the angle through which the nozzle 20 will swing or oscillate during each revolution of member 18 relative to member 16.

A spray nozzle 20 is mounted on, and rotatable with, the rotatable cylindrical member 18. An impact type impulse drive for rotating the upper rotatable member 18 includes a pivot bracket 22 supported by the member 18 on which is pivotably mounted an impulse or impact arm 24 having jet reaction member 26 that swings or is biased by spring or weight (not shown) into the jet and forced out by the spray from nozzle 24 causing intermittent rotation of the member 18.

Adjustable friction rotary joints are provided between at least a pair of the members such that rotation between the intermediate rotatable member 16 and the support member 12 can be at a different velocity than that rotation between the upper rotatable member 18 and the intermediate member 16. This prevents the spray nozzle from covering the same track with each rotation. With such a differential drive of movement between the rotatable members, the nozzle 20 covers a different track with each revolution with the track constantly changing during each revolution. This provides a more uniform coverage of the area covered by the spray unit. The nozzle 20 will cover the range between its maximum range and minimum range during each oscillation. The number of revolutions per oscillation will depend upon the sum of the revolutions of the rotatable members 16 and 18. The angle of oscillation will be twice the angle "A" between the rotatable members. The angle of the nozzle at its low and high points of its oscillation should be on the order of about 6 and 27 degrees respectively.

Figure 2:
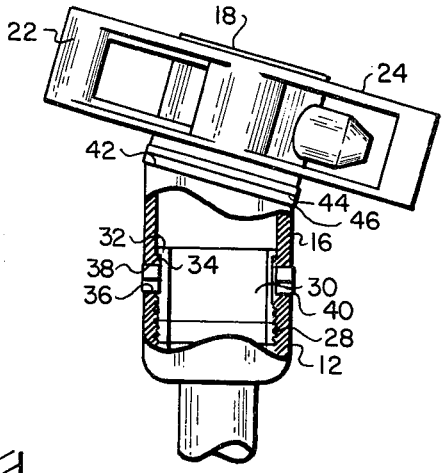
FIG. 2 is a view like FIG. 1 with a portion broken away to show internal details and with the nozzle at a different angle of lift.
Figure 6:
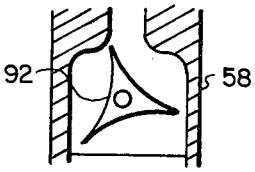
FIG. 6 is a view in section taken on line VI—VI of FIG. 3.

Turning to FIG. 2, the support member 12 is of a tubular configuration having a central cylindrical bore 28 which is threaded to receive a tubular sleeve 30. The tubular sleeve includes a radial flange 32 engaging an inwardly turned radial flange 34 of the rotatable member 16 for pulling the opposing shoulders or bearing surfaces 36 of support member 12 and 38 of rotatable member 16 into adjustable engagement with friction disks 40 disposed between the respective shoulders. This provides an adjustable drag or frictional resistance between rotation of the member 16 relative to the support member 12.

A similar coupling which may be adjustable or non-adjustable as desired provides frictional resistance or drag between the sloping shoulder or bearing surface 42 of the rotatable member 16 and the straight annular shoulder or bearing surface 44 of the top rotatable member 18. Similar frictional disks 46 as those in the lower joint may be utilized between these shoulders.

With this arrangement, one or other of the joints between the member 16 and either member 12 or 18 may be adjusted such that rotation of the upper rotatable member 18 carries with it the rotatable member 16. In the usual situation, the upper joint would be adjusted to provide a higher drag or force than the lower joint such that rotation of the upper member 18 carries with it the lower member 16. A differential adjustment provides for a differential motion or rate of rotation such that the rotation of the upper member 18 relative to the member 16 is different than the rate of rotation between the member 16 and the support member 12. This, as previously explained, provides a constantly changing spray pattern over the area covered because the angle of spray nozzle 20, herein termed the lift angle, is constantly changing during each rotation.

Figure 3:
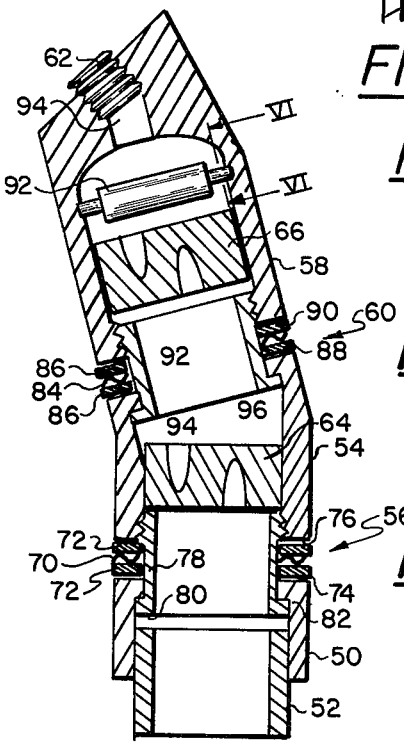
FIG. 3 is a side elevation view in section of an alternate embodiment of the invention.
Figure 5A:
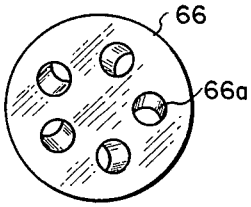
FIG. 5*a* is a top view of the upper turbine of the FIG. 3 embodiment; and, FIG. 5*b* is a sectional view of the turbine 5*a*.
Figure 5B:
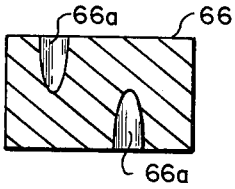
Figure 4A:
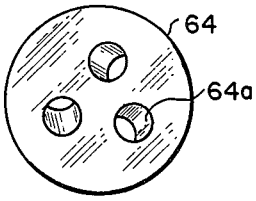
FIG. 4*a* is a top view of the lower turbine of the embodiment of FIG. 3.
Figure 4B:
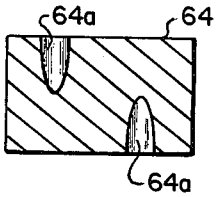
FIG. 4*b* is a sectional view of the turbine of FIG. 4*a;*

Turning to FIG. 3, an alternate embodiment of the invention is illustrated wherein a base support member includes a collar 50 attachable by threads, glue or by other means to a water supply line 52. A first or intermediate rotatable member 54 is rotatably mounted by a suitable coupling means providing a slip joint designated generally by the numeral 56 to the base support member 50.

An upper rotatable member 58 is rotatably mounted on the upper sloped end of the intermediate rotatable member 54 by means of a slip joint designated generally by the numeral 60. A spray nozzle or head 62 is carried by the upper rotatable member 58 for directing jets of water over the area to be covered. The intermediate rotatable member 54 is driven by a water turbine 64 mounted within the bore of the member 54 and nonrotatably coupled thereto such as by directly bonding the turbine to the walls of the intermediate member. Other suitable coupling means such as splines, key ways, or the like may also be utilized.

A similar water turbine 66 is mounted within the through bore of the member 58 and coupled to the walls thereof for rotating the upper rotatable member.

The friction joint 56 may be adjustable or not as desired, but in the illustrated embodiment the joint includes friction means in the form of a wavy spring 70 disposed between a pair of friction disks 72 between shoulders 74 of the support member 50 and 76 of the rotatable member 54. A collar 78 having a flange 80 engaging a flange 82 on the member 50 and threadably engaging the bore of member 54 couples the rotatable member 54 to the support member 50.

The rotatable joint 60 is similar to the previously described joint and includes a wavy spring 84 disposed between a pair of friction disks 86 frictionally engaging opposing shoulders 88 and 90 of the respective intermediate member 54 and upper rotatable member 58. A threaded sleeve 92 having a flange 94 interfitting with or engaging an inner-flange 96 of the intermediate rotatably member 54 and threadably engaging the bore of the upper rotatable member 58 couples the upper member 58 to the lower member 54. With the illustrated embodiment the drag or friction within the joints between the relatively rotatably members can be adjusted for adjusting the relative rotation between the respective members.

Alternatively, the joints can be fixed (i.e. nonadjustable) and the rate of relative rotation achieved by means of the respective turbines 64 and 66.

Turning to *4a*, the turbine 64 for the lower rotatable member is illustrated and basically comprises a cylindrical block having a plurality of angular bores or jets 64*a* extending at an angle therethrough. The degree of the angle and/or the restriction within the jets for a given frictional drag can determine the relative rotation or velocity of rotation thereof.

Turning to FIGS. *5a* and *5b*, the jet 66 is illustrated as having five jets or passages 66*a* passing therethrough. The angle of the jets and various other parameters such as the number, size, etc. can determine the torque applied to the rotatable member for a given frictional drag and water velocity through the system. Other types of water turbines can be utilized within the rotatable members.

An impulse rotor 92 may be mounted within the chamber of rotatable member 58 for periodically interrupting the flow of water into the passage 94 to nozzle outlet 62. Such an impulse device improves coverage in some instances. The rotor is a substantially triangular shaped water wheel 92 mounted by means of spring biased pins 94 and 96 in bores 98 and 100 in the walls of rotatable member 58.

While I have illustrated and described my invention by means of specific embodiments, it is to be understood that numerous changes and modifications may be made therein without departing from the spirit and scope of the invention as defined in the appended claims.

I claim:

1. A sprinkler unit for covering a selected generally horizontal substantially planar surface area with a constantly changing pattern of spray over the planar surface comprising:

a support member for mounting on a stationary water supply and having a flow passage for communicating with a water supply, a first rotatable member rotatably mounted for rotation about a substantially vertical first axis on said support member and having a flow passage communicating with the flow passage of said support member, a second rotatable member rotatably mounted for rotation about a second axis at an angle of less than 90° to said first axis on said first rotatable member and having a flow passage communicating with the flow passage of said first rotatable member, a spray nozzle carried by said second rotatable member and having a flow passage communicating with the flow passage of said second rotatable member, said spray nozzle being directed outward in a generally horizontal direction at an angle to said second axis so that rotation of said second rotatable member relative to said first rotatable member results in a continuous change in the angle of said spray head relative to a generally horizontal surface surrounding said first axis, and means for rotating said first and said second rotatable members relative to said support member and to one another.

2. The sprinkler unit of claim 1 including means for adjusting the resistance to relative rotation between said rotatable members.

3. The sprinkler unit of claim 1 wherein said means for rotating said first and second rotatable members comprises a turbine within each member response to water flowing therethrough.

4. The sprinkler unit of claim 1 wherein said means for rotating said first and second rotatable member comprises an impulse impeller responsive to water flowing from said nozzle.

5. The sprinkler unit of claim 4 including means for adjusting the resistance to relative rotation between one of said rotatable member and the member on which it is mounted.

6. The sprinkler unit of claim 1 wherein said second axis is at an angle such that said nozzle varies between about 6 and 27 degrees relative to the horizontal.

7. The sprinkler unit of claim 6 wherein each of said rotatable members are generally cylindrical in configuration and each includes an annular shoulder supporting same for rotation.

8. The sprinkler unit of claim 7 including friction means engaging each of said annular shoulders.

9. The sprinkler unit of claim 8 including means for adjusting said friction means.

10. The sprinkler unit of claim 9 wherein said means for adjusting said friction means includes a threaded sleeve extending between adjacent relatively rotatable members members.

11. A sprinkler unit for covering a substantially planar generally horizontal surface area with a constantly changing pattern of spray comprising:

a support member for mounting on a stationary water supply within a generally horizontal area to be covered and having a flow passage for communicating with a water supply, a first rotatable member rotatably mounted for rotation about a substantially vertical first axis on said support member and having a flow passage communicating with the flow passage of said support member, a second rotatable member rotatably mounted for rotation about a second axis at an angle of less than 90° to said first axis on said first rotatable member and having a flow passage communicating with the flow passage of said first rotatable member, a spray nozzle carried by said second rotatable member and having a flow passage communicating with the flow passage of said second rotatable member, said spray nozzle being directed outward at an angle above a horizontal plane and to said second axis so that rotation of said second rotatable member relative to said first rotatable member results in a continuous change in the angle of said spray head relative to a horizontal plane between about 6 and 27 degrees above a horizontal plane, and means for rotating said first and said second rotatable members relative to one another and to said support member.

12. The sprinkler unit of claim 11 wherein each of said rotatable members is generally cylindrical in configuration and said first rotatable member includes an annular shoulder having an axis disposed at an angle to said vertical first axis and the axis of rotation of said second rotatable member coincides with the axis of said annular shoulder.

* * * * *